US005200061A

United States Patent [19]

Viscontini

[11] Patent Number: 5,200,061

[45] Date of Patent: Apr. 6, 1993

[54] DELAYED COKING

[75] Inventor: Salvatore T. M. Viscontini, Northampton, Pa.

[73] Assignee: Mobil Oil Corporation, Fairfax, Va.

[21] Appl. No.: 763,008

[22] Filed: Sep. 20, 1991

[51] Int. Cl.[5] ..... C10G 9/14

[52] U.S. Cl. ..... 208/131; 208/50; 208/132; 208/48 Q

[58] Field of Search ..... 208/131

[56] References Cited

U.S. PATENT DOCUMENTS 3,917,564 11/1975 Meyers ..... 208/131
4,404,092 9/1983 Audeh et al. ..... 208/131
4,455,219 6/1984 Janssen et al. ..... 208/131
4,534,851 8/1985 Allan et al. ..... 208/131
4,758,329 7/1988 Newman et al. ..... 208/131
4,874,505 4/1991 Bartilucci et al. ..... 208/131
5,009,767 10/1989 Bartilucci et al. ..... 208/131

*Primary Examiner*—Helane E. Myers
*Attorney, Agent, or Firm*—Alexander J. McKillop; Malcolm D. Keen; Jessica M. Sinnott

[57] ABSTRACT

During delayed coking, channels are formed in the solid coke bed to facilitate cooling of the hot coke drum. A distributor device injects a fluid, preferably steam, directly into the coke drum during delayed coking. The fluid travels through the coke bed and forms a channel which eliminates an impervious zone in the mass of solid coke. The channel allows more efficient cooling of the drum and eliminates the problem of a "hot drum" which can occur during delayed coking.

5 Claims, 2 Drawing Sheets

DELAYED COKING

FIELD OF THE INVENTION

This invention is directed to an improvement in delayed coking.

BACKGROUND OF THE INVENTION

The delayed coking process is an established petroleum refinery process which is used on very heavy low value residuum feeds to obtain lower boiling cracked products. It can be considered a high severity thermal cracking or destructive distillation and may be used on residuum feedstocks containing nonvolatile asphaltic materials which are not suitable for catalytic cracking operations because of their propensity for catalyst fouling or for catalyst deactivation by their content of ash or metals. Coking is generally used on heavy oils, especially vacuum residua, to make lighter components that can then be processed catalytically to form products of higher economic value. In the delayed coking process, the heavy oil feedstock is heated rapidly in a fired heater or tubular furnace from which it flows directly to a large coking drum which is maintained under conditions at which coking occurs, generally with temperatures above about 450° C. under a slight superatmospheric pressure. In the drum, the heated feed decomposes to form coke and volatile components which are removed from the top of the drum and passed to a fractionator. When the coke drum is full of solid coke, the feed is switched to another drum and the full drum is cooled and emptied of the coke product. Generally, at least two coking drums are used so that one drum is being charged while coke is being removed from the other.

When the coking drum is full of solid coke, the hydrocarbon vapors are purged from the drum with steam at temperatures in excess of about 800° F. The drum is then quenched with quench water to lower the temperature to below about 200° F. after which the water is drained. When the cooling step is complete, the drum is opened and the coke is removed by mining or cutting.

Hydraulic decoking is currently used to remove solidified coke from the coking drum. This process uses a high speed, high impact water jet which cuts the coke from the coking drum. Boring and cutting tools, each producing several jets of water from high pressure nozzles, are employed to mine the coke. A hole is bored in the coke and the cutting head, which follows, breaks up the coke.

The boring tool has jet nozzles which are oriented vertically downward. This tool hydraulically makes a pilot hole of about 2–3 feet in diameter from the top of the coke downwards. The cutting tool has jet nozzles oriented horizontally and cuts the coke from the drum, traveling from the top downwards or from the bottom upwards.

The cooling step is very important from the standpoint of safe operation of the unit. Decoking the unit before it is adequately cooled can subject operating personnel to hazardous steam and fumes.

Even though the coking drum may appear to be completely cooled, occasionally, a problem arises which is referred to in the art as a "hot drum". This problem occurs when a localized zone in the drum does not completely cool. It is believed that the quench water cannot effectively penetrate the zone because of the properties of the coke which makes the zone impervious to the quench water. Because the quench water cannot reach the impervious zone, it is not cooled as quickly as the rest of the coking drum resulting in a localized region of high temperatures. This condition is difficult to detect and may not be noticed by operating personnel.

The solution to the problem of a hot drum has been approached in the past by cofeeding a heavy, aromatic hydrocarbon feed which keeps the viscosity of the coker feed low during coking to reduce the occurrence of a high viscosity section which is believed to create an impervious zone. However, this technique has a limited advantage since cokers are, typically, refinery bottlenecks and sending these cofeeds, which include heavy aromatic oils, clarified slurry oils or FCC bottoms fractions, to the coker reduces the overall amount of crude which can be used in the refinery to make gasoline and other more valuable products.

Another problem encountered in the delayed coking process is that prior to decoking the drum, the drum is kept out of operation for extensive periods of time which are necessary to assure adequate cooling. A process in which the time required to cool the coking drum is reduced would be an improvement in the delayed coking process overall because having the drum out of operation lowers the coking capacity of the plant and increase the amount of quench water consumed during the cooling step.

SUMMARY OF THE INVENTION

The present invention is directed to an improvement in delayed coking. Specifically the invention is directed to increasing the efficiency of cooling a coking drum and improving the safety of decoking.

An object of the invention is the elimination of an impervious zone in a coke bed which causes a "hot drum".

Another object of the invention is an improvement in the efficiency of cooling a hot drum of coke.

A feature of the invention is the creation of a channel in the coke bed during delayed coking which eliminates an impervious zone and prevents the problem of a "hot drum".

A further feature of the invention is the formation in the coke bed of a channel which increases the efficiency of cooling the coke drum.

The invention is directed to a device for creating a channel in a bed of coke by conveying a fluid to the coking drum during delayed coking comprising: a distributor disposed about the outer periphery of the coking drum, the distributor having an inlet for receiving the fluid and at least one outlet for discharging the fluid, the outlet is in communication with the inside of the coking drum to convey the fluid to the coke bed whereby discharge of the fluid into the drum forms a channel in the coke bed during delayed coking.

The process described herein also involves the elimination of an impervious zone in a coke bed which forms inside a coking drum during delayed coking of a coker feedstock comprising discharging a fluid into the coking drum through a distributor disposed about the coking drum whereby the fluid travels through the coke bed during delayed coking and forms at least one channel in the coke bed that eliminates an impervious zone.

Additionally, the invention is directed to a method for cooling a coking drum containing hot coke comprising the steps of:

a. heating a coker feedstock to an elevated coking temperature;

b. injecting the coker feedstock into the coking drum;

c. commencing delayed coking of the feedstock;

d. discharging a fluid through a distributor disposed about the coking drum and in communication with the inside of the drum for conveying a fluid into the drum to create a channel in the hot coke; and e. quenching the coking drum with a quench liquid whereby the quench liquid flows through the channel formed in the bed of hot coke.

DETAILED DESCRIPTION OF THE INVENTION

In delayed coking processes, a heavy hydrocarbon feedstock is heated to a coking temperature usually at least 450° C. and typically in the range of 450° to 500° C. in a furnace from which it proceeds to a coking drum which is maintained under conditions at which coking occurs, typically at temperatures of at least 450° C. and under mild superatmospheric pressure, typically 35 to 700 kPa (5–100 psig). In the coking drum, thermal cracking takes place with the production of coke and the vaporous products of cracking leave the coke drum as overheads to pass to the fractionating or combination tower through which, in a conventional delayed coking operation, the feedstock also passes.

Figure 1:
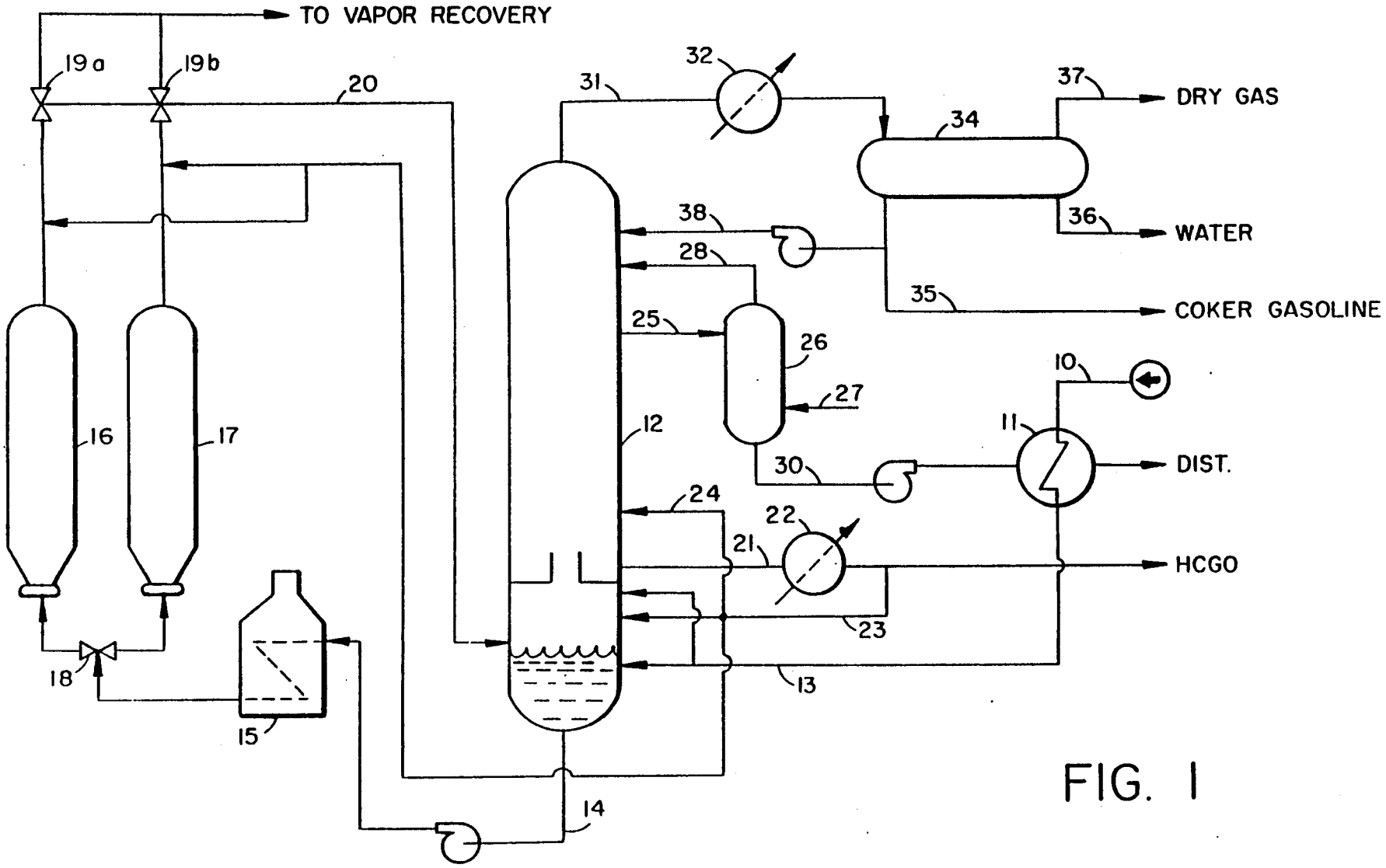
FIG. 1 is a simplified schematic flow diagram illustrating a delayed coking process.

A simplified flow diagram of a conventional delayed coker process unit is shown in FIG. 1. The heavy oil feedstock, usually a vacuum residuum, enters the unit through conduit 10 and passes through heat exchanger 11 where it is warmed. The warmed feedstock then enters fractionating tower 12 by way of conduit 13, entering the tower below the level of the coker drum effluent. In many units the feed also often enters the tower above the level of the coker drum effluent. The feed to the coker furnace, comprising fresh feed together with the tower bottoms fraction, is withdrawn from the bottom of tower 12 through conduit 14 through which it passes to furnace 15 where it is brought to a suitable temperature for coking to occur in delayed coker drums 16 or 17, with entry and exit to and from the drums being controlled by switching valve 18, 19*a* and 19*b* so as to permit one drum to be on stream while coke is being removed from the other. The vaporous cracked products of the coking process leave the coker drums as overheads and pass into fractionator 12 through conduit 20, entering the lower section of the tower below the chimney tray.

Heavy coker ga oil is withdrawn from fractionator 12 through conduit 21 and passes through cooler 22 prior to removal from the unit. A portion of the cooled gas oil is withdrawn through conduit 23 and returned to fractionator 12, entering both above and below the chimney through conduit 23 and branch conduit 24 in order to assure proper operation of the fractionator. Return of the gas oil fraction to the fractionator in this way helps to condense the heavier components of the coker effluent entering from the coke drums and to ensure that volatile components of the gas oil fraction evaporates to the higher levels in the tower. Additional, or recycled, gas oil from the coker fractionator may be introduced into drum effluent line 20 to provide a means for cooling the vaporous reaction products.

Distillate is removed from the tower through conduit 25 and is steam stripped in stripper 2 with steam supplied through steam line 27; the stripper vapor effluent is returned to the tower through conduit 28. Distillate product is withdrawn from the unit through conduit 30, passing through heat exchanger 11 where it gives up heat to the feedstock.

Coker wet gas leaves the top of the column through conduit 31 passing through heat exchanger 32 into separator 34 from which coker gasoline, water and dry gas are obtained, leaving the unit through conduits 35, 36 and 37 with a reflux fraction being returned to the fractionator through conduit 38.

When the drum is full of solid coke, as determined by the height of the coke, the feed is switched to the other drum while the full drum is cooled and emptied.

Figure 2:
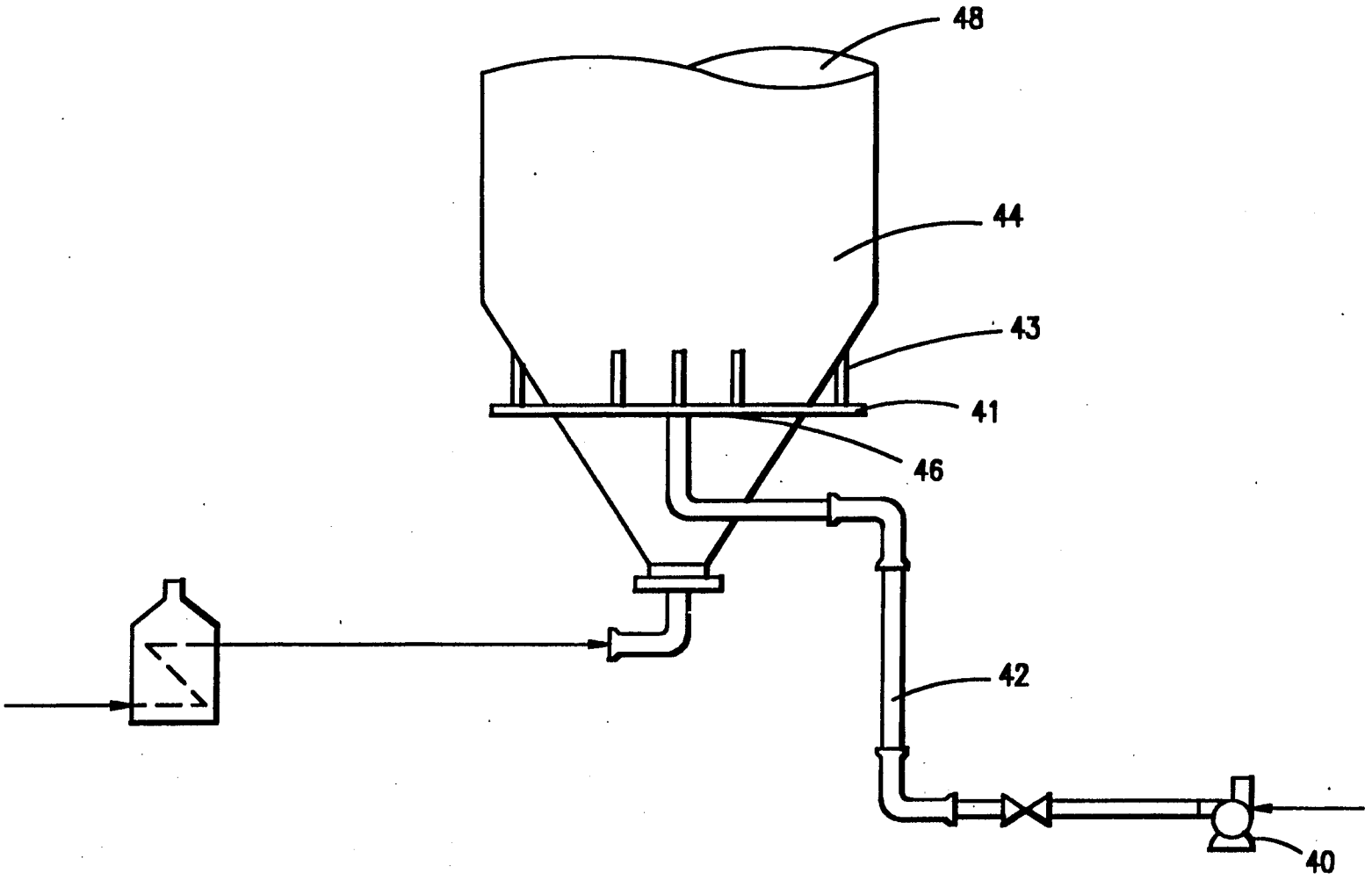
FIG. 2 is a simplified front view of the distributor device.

FIG. 2 shows the distributor device of the present invention. During the delayed coking operation either as the coking drum is being filled with hot coke or after the drum has been filled with hot coke, in accordance with the invention, a fluid is pumped through pump 40 into distributor 41 via conduit 42. The distributor includes a pipe, the pipe having an inlet 46 for receiving the fluid and at least one outlet 43 which is in communication with the inside of the coke drum 48. The fluid conveyed to the inside of the drum 48 from the outlet of the pipe 43 travels through the coke bed and creates a channel. Preferably, the distributor 41 is disposed about the lower periphery of the coke drum which facilitates formation of channels.

With respect to the configuration of the channel formed, the invention creates at least one continuous, unbroken channel from the bottom to the top of the coke bed. These channels, in addition to others caused by cooling of the bed, reduce the mean path length of cooling water to all zones in the coke bed; thus facilitating bed cooling.

The channel-forming fluid which is discharged into the coking drum is a liquid or a gas which will flow through the bed of hot coke and form a quench liquid-pervious channel. Suitable fluids include steam, an inert gas such as nitrogen, liquid or vaporized hydrocarbons, hydrocarbon gas, liquefied petroleum gas, gas oil, resid, and recycle from the fractionator or other hydrocarbon fractions having a boiling range of light gas to resid or −50° F. to 1000° F. and greater than 1000° F. Although an inert gas would perform the function effectively this would probably not be a commericially practical alternative. Gasoline, although an expensive alternative, can also be used.

An "impervious zone" is defined herein as a section of the coke bed which forms a mass of solid coke. While the invention is effective at eliminating an impervious zone which is associated with a "hot drum", use for the invention is not limited to the alleviation of a "hot drum" problem. In general, the advantage to forming a channel in a coke bed, which may or may not contain an impervious zone, is an increase in the efficiency of the cooling step. This efficiency improvement results because the quench liquid flows through the coke bed at a slower rate in the absence of a channel. In the absence of a channel the quench liquid flows in a random fashion finding its course through fractures and around the periphery of the coke bed where it contracts and pulls away from the sides of the drum as the coke cools. An imposed channel for the quench liquid, as described herein, allows the liquid to penetrate a greater area of the coke bed at a more efficient rate and can effectuate more efficient heat transfer between the hot coke and the quench water.

Although water is an effective quench liquid and is often employed for this purpose, any material which would cool the coke would function efficiently in accordance with the invention.

In the preferred embodiment of the invention, in order to encourage optimum channelling throughout the bed, about 8 outlets of about 2 inches in diameter should be used in a coke drum of about 10 to 26 feet or more in diameter.

I claim:

1. A method for cooling a coking drum containing a bed of hot coke comprising the steps of:

a. heating a coker feedstock to an elevated coking temperature;

b. injecting the coker feedstock into the coking drum;

c. commencing delayed coking of the feedstock;

d. creating a channel through an impervious zone of the coke bed by discharging a fluid through a distributor disposed about the coking drum and in communication with the inside of the coking drum said fluid creating a channel through the impervious zone as the fluid flows through the coking drum; and e. quenching the coking drum with a quench liquid whereby the quency liquid flows through the channel formed in the bed.

2. The process of claim 1 in which the fluid is steam or inert gas.

3. The process of claim 1 in which the fluid is a hydrocarbon gas, liquified petroleum gas, vaporized or liquid gas oil, gasoline, resid, recycle from the fractionator or other hydrocarbon fraction boiling in the range of from about −50° to 1000° F.

4. The process of claim 1 in which the distributor comprises a pipe which is disposed about the outer periphery of the coking drum, the pipe having an inlet for receiving the fluid and at least one outlet for discharging the fluid, the outlet is in communication with the inside of the coking drum to convey the fluid to the coke bed whereby discharge of the fluid into the coking drum forms a channel in the coke bed during delayed coking.

5. The process of claim 5 in which the distributor is disposed about the lower periphery of the coke drum.

* * * * *